United States Patent [19]

Saint-Remy Pellissier

[11] 3,968,682

[45] July 13, 1976

[54] PENETROMETERS

[75] Inventor: Charles Marc Marie Saint-Remy Pellissier, Avignon, France

[73] Assignee: Société Anonyme Fondasol-Technique, Avignon, France

[22] Filed: Jan. 24, 1975

[21] Appl. No.: 543,951

[30] Foreign Application Priority Data

Jan. 24, 1974 France ..... 74.03868

[52] U.S. Cl. ..... 73/84

[51] Int. Cl.[2] ..... G01N 33/24; G01N 3/00

[58] Field of Search ..... 73/84, 85, 83, 82, 12

[56] References Cited

FOREIGN PATENTS OR APPLICATIONS 1,553,707 1/1969 France ..... 73/85

*Primary Examiner*—James J. Gill
*Assistant Examiner*—Anthony V. Ciarlante
*Attorney, Agent, or Firm*—Karl F. Ross; Herbert Dubno

[57] ABSTRACT

A probe arrangement and set of tubes for a penetrometer. The probe is formed from a sleeve and a point which comprises a central part and a peripheral part which are connected by a cotter pin. The set of tubes comprises a central rod, which is attached to the central part of the point, and two concentric tubes around the rod. The arrangement may be used for making four independent measurements. The peripheral part of the point is connected to the sleeve in such manner that on holding the outer tube and applying a driving force to the central rod, the cotter pin shears and the central part of the point travels downwards so that hard ground may be studied.

4 Claims, 4 Drawing Figures

PENETROMETERS

The present arrangement relates to a probe arrangement and set of tubes for a penetrometer.

The penetrometer is a means for exploring the ground, which makes it possible to drive a probe placed at the lower end of a set of tubes, into the ground, ensuring the transmission of forces to a measuring head located at the top of this set of tubes.

Conventional measurements which may be undertaken by means of such a probe arrangement and set of tubes are three in number:

1 - Measurement of the point force exerted on the probe.

2 - Measurement of the resistance exerted on the lateral wall of the probe.

3 - Measurement of the resistance exerted over the entire length of the set of tubes.

In order to carry out these three measurements easily, the probe arrangement and set of tubes is currently produced in three independent parts:

1 - The point stress is registered by means of a point assembly of conical shape, integral with a central rod formed of members connected one after the other.

2 - The resistance exerted on the lateral wall of the probe is measured by means of a sleeve surmounting the conical point of the probe and integral with an intermediate tube, coaxial with the aforesaid central rod and formed like the latter of members connected end-to-end.

3 - The resistance exerted on the entire length of the set of tubes is measured on an outer tube which serves as a casing for the entire set of tubes and which is interrupted above the bottom of the afore-mentioned sleeve. This outer tube is also formed from members connected end-to-end.

In certain penetrometers, an additional measurement is carried out on the point of the probe, in order to be able to record two areas of force for the thrust on the point. The point is thus made in two parts: a central member of conical shape and a peripheral member of frustoconical shape surrounding the central member. Firstly, the two part point assembly is driven in; when it is home, one acts solely on the central conical member, which may be driven in further to a certain distance, since it has a reduced surface and the lateral force on the entire set of tubes no longer acts upon the central member.

A device of this type is described in particular in Swiss Patent No. 466,154 in the name of Raymond ANDINA and in the corresponding French Patent 1,553,707. The transmission of forces for the four measurements is carried out by means of a central rod and three concentric tubes. The rod is integral with the central conical member of the point, whereas the first tube is integral with the frustoconical peripheral member of this same point. Furthermore, a cotter pin connects the two members of the point, in order to keep the rod connected with the first tube and preventing the rod from moving alone under the action of its own weight and which facilitates the positioning of additional rod or tube members. This cotter pin is designed to be sheared and thus to release the central rod, in order to allow the fourth measurement to be taken solely with the central conical member.

Although this device is advantageous, it has a certain complexity of construction, since the central rod of the set of tubes is surrounded by three coaxial tubes.

The object of the present invention is to provide a device which, while allowing the four afore-mentioned measurements, benefits from a considerable simplification of construction by eliminating one of the tubes.

It is still an arrangement of the type comprising, on the one hand, a probe formed by a point and a sleeve, the point itself being composed of two parts, a central part and a peripheral part, connected by a cotter pin, which may be sheared to allow continuation of measurements solely on the central part of the point, on the other hand, a set of tubes formed by a central rod surrounded by coaxial tubes, which makes it possible to carry out four independent measurements in all. According to the invention, the peripheral part of the point is not connected to any intermediate tube of the set of tubes, but it is able to co-operate for the shearing of the cotter pin, with retaining means provided on the probe sleeve, which makes it possible to limit the number of tubes surrounding the central rod of the set of tubes, to two.

In a particular embodiment, the means for retaining the sleeve are constituted by a ring, screw-threaded at its lower part and comprising an upwardly directed support surface, able to co-operate with a flange provided at the top of an annular member integral with the peripheral part of the probe point.

If the tube adjoining the sleeve is kept in the closed position, the peripheral part of the point is locked and, by exerting sufficient force on the central rod of the set of tubes, it is possible to shear the cotter pin and then to act solely on the central part of the point. Before shearing, the central rod transmits all the force exerted on the two parts of the point and two coaxial tubes are thus sufficient: an intermediate tube adjoining the sleeve for measuring the lateral force on the probe and an outer tube for recording the force on the set of tubes.

According to another feature of the invention, the means ensuring centering and retaining the unit members of the single intermediate tube, whereof the base is integral with the probe sleeve, on the corresponding unit members of the outer tube, comprise a lower centering ring and an upper retaining ring able to co-operate with an upwardly directed support surface, provided in the vicinity of the top of the corresponding unit member of the tube on the outside.

Advantageously, each unit member of the outer tube comprises an attached part at its top, which part is in the form of a sleeve, which comprises simultaneously: the aforesaid support surface, a part of reduced internal diameter serving for centering the corresponding unit member of the intermediate tube and a restricted part in which may be engaged the jaws of the extraction device.

The invention will be better understood from the following description, referring to the accompanying diagrammatic drawing illustrating a non-limiting example, probe arrangement and set of tubes for a penetrometer. In the drawing.

Figure 1:
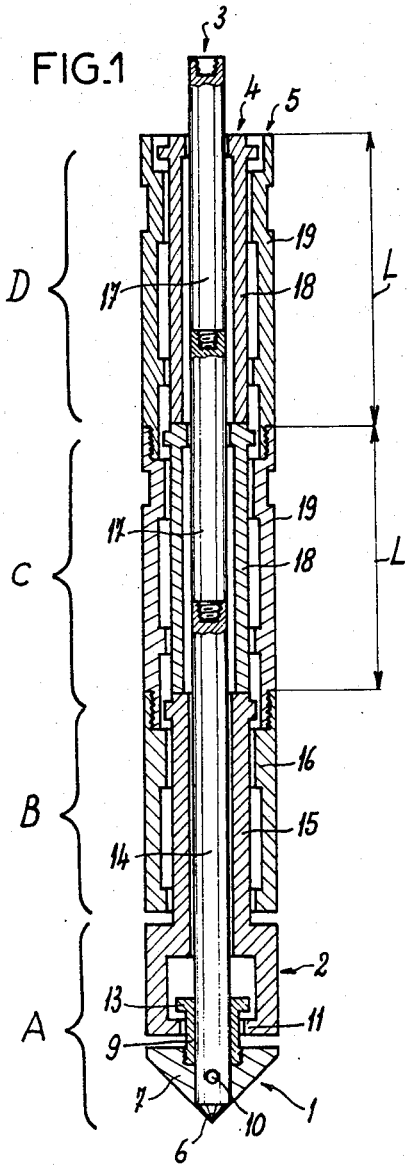
FIG. 1 is a very simplified general view, in section, showing an arrangement according to the invention.
Figure 2:
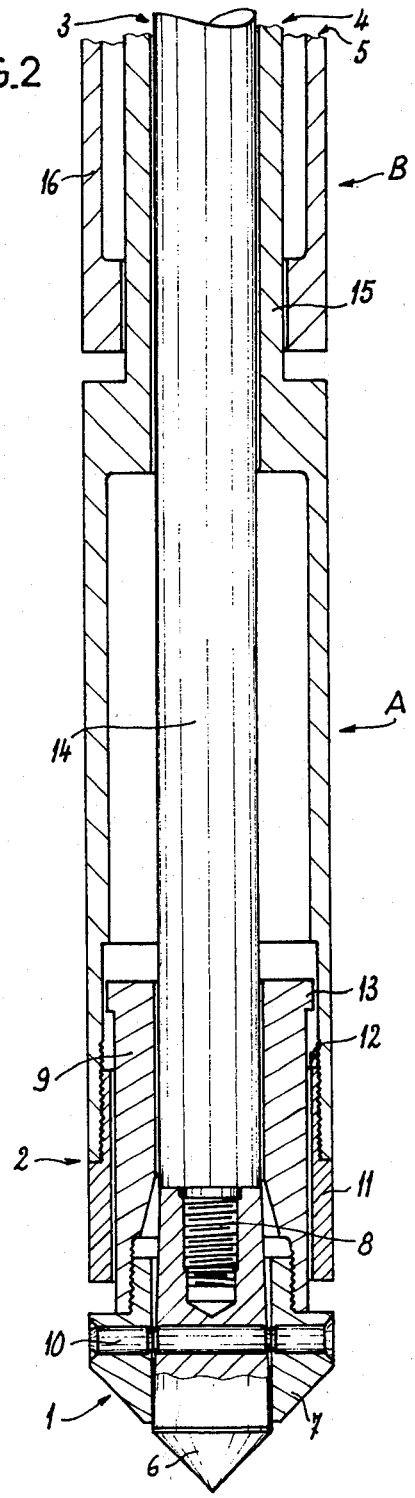
FIG. 2 is a detailed view, in section, to an enlarged scale, showing the measuring probe.
Figure 3:
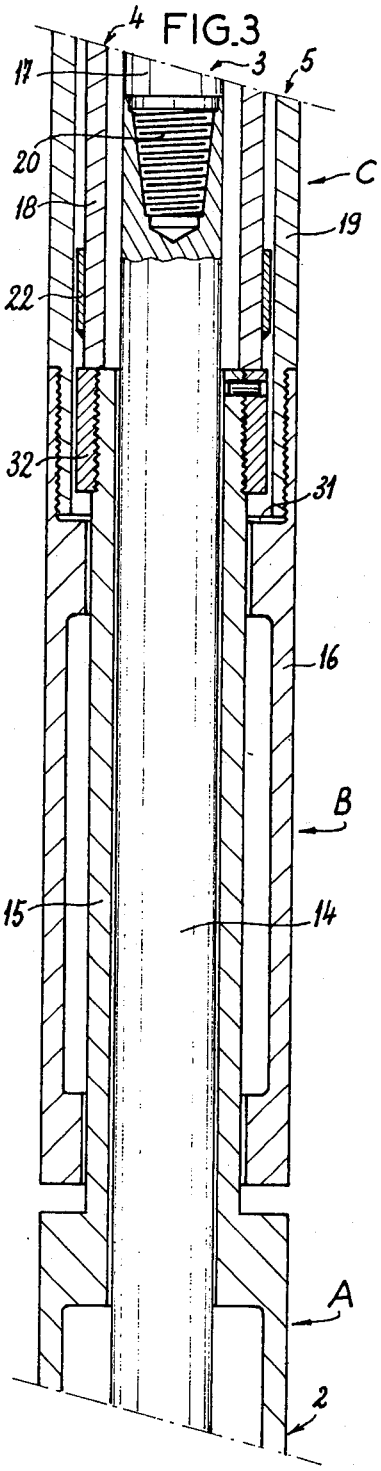
FIG. 3 is a sectional view, subsequent to FIG. 2, showing the details of the lower end of the set of tubes.
Figure 4:
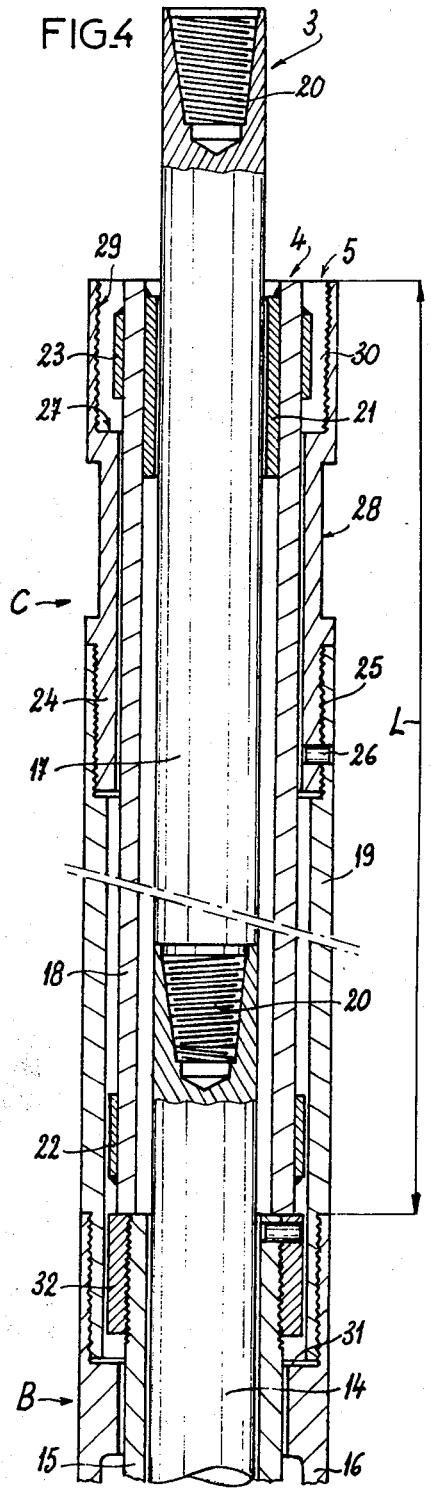
FIG. 4 is a sectional view, subsequent to FIG. 3, showing the first current unit members of this set of tubes.

The arrangement shown in FIG. 1, comprises, starting from the bottom, a penetrometer probe A, the lower section B of the set of tubes which supports the probe A and has certain features, then two current sections C and D of the set of tubes. The probe A is itself constituted by two main parts, which are a point 1 of conical shape and a sleeve 2 of cylindrical shape, surmounting the point 1. The set of tubes is generally composed of a central rod 3 surrounded by two coaxial tubes, an intermediate tube 4 and an outer tube 5. In FIG. 1, it should be noted that the transverse dimensions are very exaggerated with respect to the longitudinal dimensions.

The point 1 is itself divided into two coaxial parts which are: a central conical member 6 and an annular peripheral member 7 of frustoconical shape, extending outwardly from the central member 6. The central member 6 is screwed to the lower end of the central rod 3 of the set of tubes and, to this end, it comprises a screwthread 8. The peripheral member 7 is surmounted by an annular part 9 of smaller diameter than the bottom of the sleeve 2 surrounding the base of the central rod 3 and engaging in the sleeve 2.

The two members 6 and 7 forming the point 1 are connected by a calibrated cotter pin 10, arranged in a diametral direction.

The sleeve 2 has an outer diameter equal to that of the point 1. At its lower end, it comprises a screwthreaded ring 11 which extends it downwards and inwards. In particular, this ring comprises an upper surface 12 (inwardly extending part) located opposite the inner surface of a flange 13 (outwardly extending shoulder) provided at the top of the annular part 9. The upper part of the sleeve 2 is integral with the base of the intermediate tube 4 of the set of tubes.

The set of tubes comprises a lower portion B, whereof the length is less than that of the current sections C and D and has certain peculiarities. The section B comprises:

The lower member 14 of the central rod 3, to which is screwed the central member 6 of the point 1;

the lower member 15 of the intermediate tube 4, integral with the sleeve 2 of the probe A;

the lower member 16 of the outer tube 5, of the same diameter as the sleeve 2 and interrupted just above the latter.

In the same manner, each of the sections C and D of the set of tubes is composed:

Of a unit member 17 of the central rod 3;

of a unit member 18 of the intermediate tube 4;

and of a unit member 19 of the outer tube 5.

These unit members all have a length L of one meter for example and they are described in more detail hereafter:

Each member 17 of the central rod 3 has a diameter of 35mm for example. It is connected to the adjacent members by means of conical screwthreads 20 provided at its ends. The upper end of each member 17 projects above two tubular members 18 and 19 of the same section of the set of tubes.

Each member 18 of the intermediate tube 4 is in the form of a tube having an inner diameter of 46mm and an outer diameter of 60 mm for example. At its upper end, it comprises an inner ring 21 ensuring its centering with respect to the central rod 3 and its two ends are also provided with outer rings, 22 and 23 respectively. The lower ring 22 ensures centering of the member 18 with respect to the outer tube 5. The upper ring 23 facilitates retention of the member 18 by the member 19 of the outer tube 5 which surrounds it. The unit members 18 of the intermediate tube 4 are not screwed to each other, but are simply superimposed.

Each member 19 of the outer tube 5 is in the form of a tube having, in its present section, an inner diameter of 68mm and an outer diameter of 83mm for example. Its upper part comprises an attachment member 24, in the form of a sleeve, screwed by means of a screwthread 25 and connected by means of a pin 26 to the remainder of the tube. This part 24 has a certain number of peculiarities:

Its inner diameter is less than that of the remainder of the member 19, in order that it may serve for centering the upper part of the member 18 of the intermediate tube 4.

It has a support surface 27 located opposite the retaining ring 23 of the aforesaid member 18.

It has a restricted part 28 extending to a certain height.

Finally, at its upper part, it comprises an internal screwthread 29 facilitating its connection to the externally screwthreaded lower part of the member 19 located directly above. The presence of the screwthread 29 provides a housing 30, in which is located the ring 23 for retaining the intermediate member 18.

When this probe arrangement and set of tubes is operating, the point force is transmitted by the central rod 3, the lateral force on the sleeve 2 is transmitted by the intermediate tube 4 and finally the lateral force on the entire set of tubes is exerted on the outer tube 5, which transmits it to the measuring head.

During a penetration test, the probe is firstly driven in with the first section of the set of tubes, then, as the probe is driven in, additional sections are added, firstly by screwing the member 17 of the central rod, then by fitting the two tubular members 18 and 19. The central rod 3 transmits the force exerted on the point arrangement 1 as long as the complete set of tubes is driven into ground of slight or average resistance.

For studying harder ground, solely the central part 6 of the point 1 is used. To this end, the outer tube 5 is held firmly, which in turn retains the sleeve 2 by means of the support surface 31 of the lower outer member 16. In fact, this support surface co-operates with a ring 32 integral with the upper end of the intermediate member 15, which is integral with the sleeve 2. The sleeve 2 retained in this way thus prevents any driving-in of the peripheral part 7 of the point 1, since the support surface 12 of said sleeve stops the flange 13 of the part 9 integral with the part 7. A downwards thrust of predetermined value, for example 16 tons is thus exerted on the central rod 3, at which force the cotter 10 is sheared and it is then possible to drive in solely the central part 6 of the point 1.

For extraction, there are engaged in the restricted part 28 of the upper outer member 19, the four jaws of an extraction device controlled by rams. Thus, by raising the outer tube 5, the intermediate tube 4 is also entrained by the retaining means constituted by the support surfaces 27 co-operating with the rings 23 of the members 18 of the intermediate tube.

When dynamic driving-in is not used, the set of tubes is surmounted by the measuring head, which is not part of the invention and which comprises all the members facilitating on the one hand, static driving-in of the set of tubes and on the other hand, its extraction, while allowing the transmission of all forces to the various pick-ups. Each member of the set of tubes comes into direct abutment with the member of this measuring head provided for transmitting the force to the corresponding pick-up.

Naturally, the invention is not limited to the single embodiment of this probe arrangement and set of tubes which was described above as a non-limiting example. On the contrary, it includes all variations comprising equivalent means, the latter applying in particular to the various means for retaining a part with respect to another part, which have been afore-described.

I claim:

1. A penetrometer probe comprising:

a central point;

a rod connected to said point and extending the length of the probe;

a frustoconical annular member surrounding said point;

a shear pin traversing said member and said point for joint movement of said member and said point upon displacement of the latter by said rod;

a sleeve circumferentially spaced from said rod in the region of said point and extending axially along said rod directly adjacent thereto over the length of the probe;

an outer tube surrounding said sleeve and terminating above said point while extending the length of said probe, said rod, said sleeve and said outer tube being connectable to a penetration measuring device; and coupling means in the space between said sleeve and said rod in the region of said point for conecting said sleeve and said member in force-transmitting relation enabling shearing of said pin, said coupling means comprising an annular part affixed to said member and surrounding said rod, said annular part being of a diameter less than that of the sleeve at the lower end thereof and having an annular outwardly extending shoulder said annular part terminating below the bottom of said outer tube, said lower end of said sleeve being formed with an inwardly extending part engageable with said shoulder upon relative axial displacement of said sleeve and said rod to cause said shearing of said pin.

2. The penetrometer probe defined in claim 1 wherein said member has an upwardly extending sleeve portion coaxial with said rod above said point and threadedly engaging said annular part, said inwardly extending part being a bushing threaded into the lower end of said sleeve, said shoulder being engageable with said bushing.

3. The pènetrometer probe defined in claim 2 wherein said sleeve is formed with a plurality of axially spaced centering rings for positioning said outer tube and said rod relative to said sleeve along the length of the probe.

4. The penetrometer probe defined in claim 2 wherein said tube and said sleeve are formed along the length thereof with regions of reduced diameters for engagement by an extraction device.

* * * * *